343-700 MS AU 256 EX
12/19/78 OR 4,130,822

United States Patent [19]

Conroy

[11] 4,130,822

[45] Dec. 19, 1978

[54] SLOT ANTENNA

[75] Inventor: Peter J. Conroy, Scottsdale, Ariz.

[73] Assignee: Motorola, Inc., Schaumburg, Ill.

[21] Appl. No.: 701,481

[22] Filed: Jun. 30, 1976

[51] Int. Cl.[2] ..... H01Q 1/38

[52] U.S. Cl. ..... 343/700 MS; 343/767; 333/84 M

[58] Field of Search ..... 343/767, 768, 771, 700 MS; 333/84 M, 735

[56] References Cited

U.S. PATENT DOCUMENTS

| | | | |
|---|---|---|---|
| 2,996,713 | 8/1961 | Boyer | 343/700 MS |
| 3,541,557 | 11/1970 | Miley | 343/700 MS |
| 3,665,480 | 5/1972 | Fassett | 343/854 |
| 3,947,850 | 3/1976 | Kaloi | 343/700 MS |
| 4,017,864 | 4/1977 | Proctor | 343/767 |

FOREIGN PATENT DOCUMENTS

| | | | |
|---|---|---|---|
| 1050583 | 9/1953 | France | 343/705 |

*Primary Examiner*—Eli Lieberman
*Attorney, Agent, or Firm*—Michael D. Bingham

[57] ABSTRACT

A stripline radiating element for use in a flat plate antenna array. The radiating element is comprised of a stripline sandwich including first and second stripline boards. A U-shaped slot is etched in the ground plane of the first stripline board and an open circuit transmission line is disposed between the two sandwiched boards for coupling energy to the slot. The inner dimensions of the slot form a strip transmission line with one end thereof, which is opposite the slot portion, being terminated in a short circuit which is formed by plated through holes between both ground planes of each individual stripline board. The length of the open circuited strip transmission line is adjusted to resonate with the slot susceptance and the reactance of the short circuited transmission line.

5 Claims, 5 Drawing Figures

SLOT ANTENNA

BACKGROUND OF THE INVENTION

This invention relates to antennas and more particularly to a stripline slot antenna element suitable to be used in flat plate antenna arrays.

Stripline slot antennas are well known in the art. These antennas are generally formed by etching a radiating aperture (slot) on one ground plane of a stripline sandwich circuit. The stripline sandwich comprises a conducting strip, and a transmission line insulatively disposed between two ground planes. Energy is coupled to the slot over the transmission line with the electric fields propagated thereon confined within the dielectric boundaries between the ground planes. To maintain mode purity, to prevent moding problems, prior art stripline antennas have required the use of cavities formed opposite of the radiating aperture. These cavities are usually formed by either placing plated through holes at predetermined distances about the radiating aperture, or by using rivets between the ground planes. Another method is to form a physical cavity on the ground plane opposite the radiating slot.

The use of cavities has limited the bandwidth performance of these prior art antennas. Typically, the bandwidth of such stripline antennas are 3% to 5%. Hence, flat plate antenna arrays comprised of such antenna elements are typically limited to bandwidths of 2% to 3% and an efficiency factor of no greater than 35%.

Because the slot is itself a relatively broadband radiator, if the cavity could be eliminated, the bandwidth performance of a slot antenna element could be improved. Such an improvement would give rise to an associated increase in an array efficiency factor.

Thus, a need exists for eliminating a requirement for cavity backed slots in order to provide stripline slot antennas having improved bandwidth performances.

Accordingly, it is an object of the present invention to provide an improved slot antenna element.

It is another object of the present invention to provide a stripline slot antenna which requires no resonant cavity.

It is a further object of the invention to provide a stripline slot antenna of a particular configuration requiring no cavity and which is suitable to be utilized in flat plate antenna arrays.

SUMMARY OF THE INVENTION

The foregoing and other objects are met in accordance with the present invention by providing a stripline slot antenna element suitable to be used in flat plate antenna arrays.

According to one feature of the invention, the stripline antenna element is formed in a stripline sandwich circuit including first and second dielectric boards having parallel opposed ground planes of copper clad material. The radiating element of the antenna is formed by etching a rectangular slot in the ground plane of the first board. A feed network comprising a strip transmission line and microstrip line is disposed between the ground planes. The stripline portion is asymmetrically disposed between the two ground planes to facilitate stripline to microstrip transition without generating undesirous TM modes and to optimize the bandwidth of the slot element. A U-shaped radiating slot is thus formed between the ground plane of the first board and the input end of the microstrip matching line. The opposite end of the microstrip line is shorted to both ground planes with the length thereof being chosen to cancel the positive susceptance of the slot admittance.

In accordance to another feature of the invention, a microstrip line is formed on one ground plane surface which has one end thereof terminated in a short circuit to both ground planes of the stripline sandwich circuit. A U-shaped slot is formed between the edge of the microstrip line and the upper ground plane. An open circuited conduction strip is disposed between the two boards in spatial relation to the microstrip line. Input energy is propagated in a TEM mode along the strip line feed network and is radiated from the U-shaped slot. The length of the open-circuited strip line feed network is adjusted to resonate with the slot susceptance and the short circuited microstrip reactance.

The matching of the slot impedance provides a strip line antenna element exhibiting a bandwidth on the order of 10% to 15% for ground plane to wavelength spacing ratios of 0.07 $\lambda_{\epsilon r}$.

DETAILED DESCRIPTION OF THE PREFERRED EMBODIMENT

Figure 1:
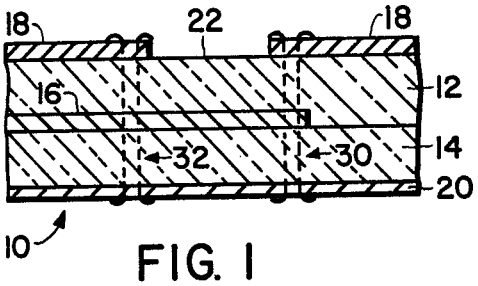
FIG. 1 is a cross-sectional view of the stripline slot antenna of one embodiment of the present invention.
Figure 2:
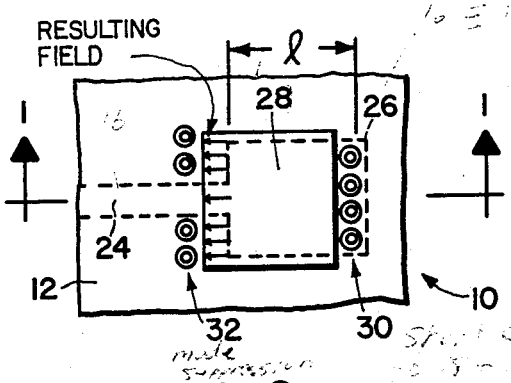
FIG. 2 is a top view of the stripline antenna of FIG. 1.
Figure 3:
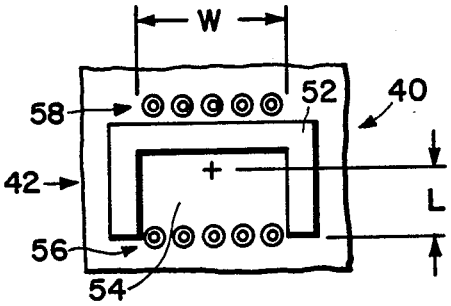
FIG. 3 is a top view of a stripline slot antenna of a second embodiment of present invention.
Figure 4:
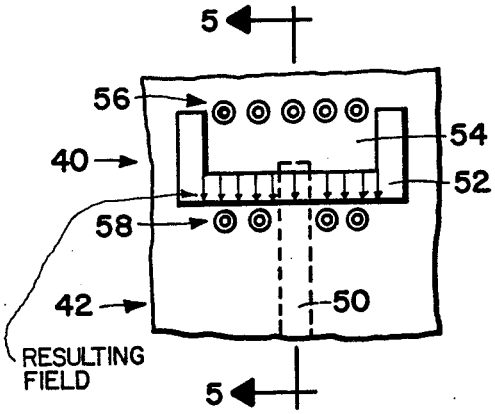
FIG. 4 is a top view of the antenna of FIG. 3 showing the open circuited stripline feed network.
Figure 5:
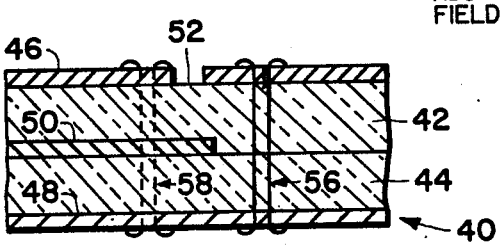
FIG. 5 is a cross-sectional view of the stripline slot antenna of FIGS. 3 and 4.

Referring to FIGS. 1 and 2, there is illustrated stripline slot antenna element 10 of one embodiment of the present invention. It is to be understood that the slot antenna elements hereinafter disclosed may be one constituent radiating element of a multielement flat plate antenna array.

Slot antenna 10 is shown as comprising two copper-clad dielectric boards 12 and 14 which may be bonded together to form a stripline sandwich circuit, as is known in the art. A flat conducting strip 16 is disposed between upper ground plane 18 and lower ground plane 20. A radiating aperture 22 is formed in upper ground plane 18 of rectangular shape. Aperture 22 may be formed by etching using known techniques. Conducting strip 16 includes stripline 24 and microstrip line 26 which form a matching network. As is observed, a U-shaped radiating slot 28 is formed between ground plane 18 and microstrip transmission line 26. The end of microstrip line 26, opposite the input feed, is short circuited to both ground planes 18 and 20 by, for example, plated through holes which are shown typically by reference numeral 30. Similarly, mode suppression is provided by plated through holes 32. It is to be understood that plated through holes 30 and 32 may be provided by rivets, screws and other means, the choice of which depends on the designer.

In operation, the length, l, of microstrip line 26 is chosen to produce a negative susceptance which cancels the positive susceptance of the slot admittance. This establishes a real conductance input value at the microstrip line input. The conductance input value can be readily matched using a well known quarter wave length transformer section, which may be a portion of strip line 24 (not shown). Input energy which is applied to stripline 24 is conducted in essentially a TEM mode and radiated from slot 28. Energy is applied to stripline 24 either by end-launching or by the use of right angle connections as is understood.

It has been shown by R. F. Harrington in an article entitled, "Time-Harmonic Magnetic Fields", McGraw-Hill, 1961, pages 182–183, that the aperture admittance of a capacitive slot radiator for small values of ka; i.e., $a/\lambda < 0.1$:

$$\left.\begin{aligned} Ga &\simeq \frac{W\pi}{\lambda\eta} && (1)\\ Ba &\simeq \frac{W}{\lambda\eta}\,[3.135 - 2\log ka] && (2)\end{aligned}\right\} a/<.1$$

where:

W = slot length $\eta = 377\Omega$ a = slot thickness

Moreover, it is known that to a first approximation, the admittance of a shortcircuited microstrip line is equal to:

$$-j/z \tan\theta \qquad (3)$$

where: Z = microstrip line impedance $$\theta = 2\pi l/\lambda\epsilon r$$

$\lambda\epsilon r$ = wave length in dielectric

Hence, the length, l, of microstrip line 26 is determined by setting equation 3 equal to equation 2 such that:

$$l = \frac{\lambda\epsilon r}{2\pi}\tan^{-1}\left(\frac{1}{BaZ}\right) \qquad (4)$$

or $$l = \frac{\lambda\epsilon r}{2\pi}\tan^{-1}\frac{\eta\lambda\epsilon r}{Z(1)}(3.135 - 2\log ka) \qquad (5)$$

Thus, by adjusting the quantity, 1, a real conductance value, $G_A$ for the antenna element is derived which is equal to the value as shown by equation 1.

Turning now to the remaining Figures, there is illustrated stripline slot antenna 40 of another embodiment of the invention. Antenna 40 is fabricated in the same manner as antenna 10 and comprises copper-clad dielectric boards 42 and 44 bonded together, for instance. Disposed between upper and lower ground planes 46 and 48, respectively, is open-circuited stripline 50 adapted to receive and couple energy to U-shaped slot 52. The slot is formed between the edge of microstrip line 54, which is short circuited by plated through holes 56, and upper ground plane 46. Plated through holes 58 are supplied for mode suppression as before. U-shaped slot 52 is formed by etching the copper-clad material from ground plane 46.

In a similar manner as previously discussed, the length, L, of microstrip line 54 is chose such that the transformed slot susceptance is cancelled by the negative short circuit susceptance. The length of open-circuited strip transmission line 50 is then adjusted to resonant with the slot susceptance and short circuited microstrip reactance of microstrip line 54 to match the input of antenna element 40 to approximately 50 ohms.

Several slot antenna elements have been fabricated using the concepts as described above. For a maximum voltage standing wave ratio (VSWR) of 2:1 and a ground plane spacing ratio $S/\lambda \simeq 0.07$, bandwidths from 6% to 16% were exhibited as the slot dimension, W, was varied from $0.44\lambda$ to $0.5\lambda$.

Thus, what has been described is a unique stripline slot antenna element having minimum slot dimensions and increased bandwidth. The antenna is in the form of a U-shaped radiating aperture. The impedance of the aperture is matched by microstrip matching lines. The reduced slot size and increased bandwidth characteristics allow for the construction of flat plate antenna arrays having higher efficiency characteristics.

What is claimed is:

1. An antenna having improved bandwidth characteristics which is suitable for conformal arraying, comprising:

ground plane conductor means;

rectangular transmission means for forming a radiating element which is spaced from said ground plane conductor means;

dielectric spacing means for separating said ground plane conductor means and said rectangular transmission means;

said rectangular transmission means having one end of the length thereof being shorted to said ground plane conductor means with the other end of the length thereof being open circuited, said rectangular transmission means having an optimum feedpoint at a predetermined distance from said short circuited edge so that the input of the antenna at said predetermined distance from said shorted end is matched to a real impedance value;

additional ground plane conductor means being shorted to said ground plane conductor means and surrounding said rectangular transmission means such that a U-shaped slot is formed about the width and open circuited end of said rectangular transmission means; and feed means for coupling energy to said input of the antenna whereby energy is radiated from the antenna.

2. The antenna in claim 1 wherein said dielectric spacing means includes first and second dielectric substrates each having first and second planar opposing surfaces, said ground plane conductor being contiguous to said second surface of said first dielectric substrate, said rectangular transmission means being contiguous to said second surface of said second dielectric substrate, said first surfaces of said first and second dielectric substrates being contiguous to one another.

3. The antenna of claim 2 wherein said feed means includes a conducting strip disposed between said first and second dielectric substrates and being at substantially a 90° angle with respect to said open circuited end of the length of said rectangular transmission means such that feed means is resonant with the matched impedance of said input of the antenna.

4. The antenna of claim 3 including said additional ground plane conductor means being contiguous to said second surface to said second dielectric substrate.

5. A slot antenna, comprising:

a first dielectric substrate having first and second planar opposing surfaces;

a second dielectric substrate having first and second planar opposing surfaces, said first surfaces of said first and second dielectric substrates being substantially contiguous to one another;

first ground plane conductor means contiguous to said second surface of said first dielectric substrate;

stripline conductor means disposed between said first and second dielectric substrates;

microstrip transmission means contiguous to said second surface of said second dielectric substrate having one end of the length thereof short circuited to said first ground plane conductor means and the other end of the length thereof being open circuited, said microstrip transmission means having an optimum feed point at a predetermined distance from said short circuited end at which the input of the antenna has a substantially matched real impedance value;

said stripline conductor means having first and second open circuited ends with one of the ends thereof being disposed beneath said microstrip transmission means, said stripline conductor means being at a substantially 90° angle with respect to the open circuited end of said microstrip transmission means, said stripline conductor means receiving energy supplied to the antenna at the other end thereof for coupling the same to the matched input of the antenna; and second ground plane conductor means contiguous to said second surface of said second dielectric substrate, said second ground plane conductor means being short circuited to said first ground plane conductor means and surrounding said microstrip transmission means such that an U-shaped slot is formed about the width and open end of said microstrip transmission means.

* * * * *